US011084156B1

(12) United States Patent
Jordan et al.

(10) Patent No.: US 11,084,156 B1
(45) Date of Patent: Aug. 10, 2021

(54) TOOL FOR DRIVING AN ITEM INTO THE GROUND

(71) Applicants: David S. Jordan, Knoxville, TN (US); Michael C. Jordan, Knoxville, TN (US)

(72) Inventors: David S. Jordan, Knoxville, TN (US); Michael C. Jordan, Knoxville, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 269 days.

(21) Appl. No.: 16/350,109

(22) Filed: Sep. 26, 2018

Related U.S. Application Data

(60) Provisional application No. 62/606,645, filed on Oct. 2, 2017.

(51) Int. Cl.

| | |
|---|---|
| ***B25D 17/00*** | (2006.01) |
| ***E04H 12/34*** | (2006.01) |
| ***E04H 17/26*** | (2006.01) |
| ***B25D 16/00*** | (2006.01) |

(52) U.S. Cl.
CPC ..... *B25D 17/00* (2013.01); *E04H 12/347* (2013.01); *E04H 17/263* (2013.01); *B25D 16/00* (2013.01); *B25D 2216/00* (2013.01); *B25D 2250/051* (2013.01)

(58) Field of Classification Search
CPC ..... B25C 11/00; E04H 12/347; E04H 17/263; E04H 17/26; E04H 17/265
See application file for complete search history.

(56) References Cited

U.S. PATENT DOCUMENTS

| | | | | |
|---|---|---|---|---|
| 3,454,113 | A * | 7/1969 | Holtz | E04H 17/263 173/129 |
| 4,190,118 | A * | 2/1980 | Sweeney | E02D 13/10 173/130 |
| 4,641,715 | A * | 2/1987 | Stinson | E02D 11/00 173/129 |
| 5,029,427 | A * | 7/1991 | Jewett | E04H 17/263 52/749.1 |
| 2017/0058559 | A1* | 3/2017 | Martin | E02D 7/00 |
| 2019/0262982 | A1* | 8/2019 | Ebner | B25D 17/005 |

* cited by examiner

*Primary Examiner* — Tyrone V Hall, Jr.
(74) *Attorney, Agent, or Firm* — Michael E. McKee

(57) ABSTRACT

A tool for use with a hammer driver having a pin-accepting socket for driving a ground rod into the ground includes a body having two opposite side faces and at least one ground rod-accepting passageway extending between the two side faces. The tool also includes a guide pin which is joined to so as to extend from one of the side faces of the body and an elongated socket portion having first and second opposite ends and having a hollow interior which opens out of a first end of the socket portion. In addition, the socket portion is secured to the other side face of the body by way of the second end so that the first end extends away from the other side face of the body, and the guide pin and the elongated socket portion are axially-aligned with one another.

16 Claims, 8 Drawing Sheets

TOOL FOR DRIVING AN ITEM INTO THE GROUND

The benefit of Provisional Application Ser. No. 62/606,645, filed Oct. 2, 2017 and entitled GROUND ROD DRIVING TOOL, is hereby claimed. The disclosure of this referenced provisional application is incorporated herein by reference.

BACKGROUND OF THE INVENTION

This invention relates generally to tools and accessories for driving an item, such as a ground rod or post, into the ground.

The class of items with which this invention is concerned includes an elongated portion having a lower end which is desired to be driven into the ground. One such item is a ground rod comprised of a conducting material, such as copper, and which possesses the form of an elongated cylindrical rod having a length which ranges, for example, from between eight and ten feet. These ground rods are typically desired to be driven bottom end-first vertically into the ground to a condition at which the upper end of the ground rod is disposed at or beneath the level of the ground.

Another such item is a post (e.g. a fence post) commonly constructed of metal and possessing a substantially T-shaped cross section. Such a post has an upper end and a lower end and is typically desired to be driven lower end-first vertically into the ground to a condition at which the upper end of the post remains above the level of the ground.

Because of the length of common ground rods and in order to make initial impact with the upper end of a such ground rod desired to be driven bottom end-first into the ground, an operator would typically be required to stand atop a ladder or other elevated platform to reach the upper end of the ground rod with a rod-driving tool. There exists conventional rod-driving tools which enable an operator to stand upon the ground while the ground rod is driven for a substantial distance into the ground, but none of these tools can also be utilized for driving the ground rod through a final phase of movement for positioning the ground rod at or beneath the level of the ground.

It would be desirable to provide a single ground-driving tool which can be used, in conjunction with a hammer driver, for driving a ground rod into the ground through both an initial phase of movement and a final phase of movement at which the upper end of the ground rod is disposed at or beneath the level of the ground.

It would also be desirable to provide such a tool whose principles of operation are adaptable to tools for driving other elongated items, such as posts, into the ground with a hammer driver.

Accordingly, it is an object of the present invention to provide a new and improved tool with which an item, such as a ground rod or post, can be driven into the ground.

Another object of the present invention is to provide such a tool which is suitable for driving elongated items into the ground wherein the elongated items can possess different cross-sectional shapes or sizes.

Still another object of the present invention is to provide such tool which, when used in conjunction with a hammer driver, can be used to drive a ground rod into the ground throughout both an initial rod-driving phase of movement and a final phase of movement at which the upper end of the ground rod is disposed at or beneath the level of the ground.

Yet another object of the present invention is to provide such a tool which is uncomplicated in structure, yet effective in operation.

SUMMARY OF THE INVENTION

This invention resides in a tool for use with a hammer driver having a pin-accepting socket for driving an item, such as a ground rod or post, into the ground wherein the item has a lower end which is desired to be driven into the ground.

The tool includes a body which is positionable in cooperating relationship with the item to be driven into the ground so that forces which are exerted downwardly upon the body in a substantially vertical or near-vertical direction prevents the movement of the body relative to the item. The tool also includes a guide pin which is joined to so as to extend from the body and which is adapted to be received by the pin-accepting socket of the hammer driver so that by positioning the body in said cooperating relationship with the item at a location therealong which is above the lower end thereof, positioning the pin-accepting socket of the hammer driver about the guide pin and then driving the body downwardly in a substantially vertical or near-vertical direction with the hammer driver, the lower end of the item is driven into the ground.

In a particular embodiment of the present invention, the tool is used for driving a ground rod into the ground and further includes an elongated socket portion having first and second opposite ends and having a hollow interior which opens out of the first end of the socket portion. Moreover, the socket portion is joined to so as to extend from a side of the body opposite the guide pin, the hollow interior of the socket portion is sized to accept the upper end of the ground rod when directed open end-first over the upper end of the ground rod, and the guide pin and the elongated socket portion are axially-aligned with one another so that the ground rod can be driven into the ground with the tool by either a) positioning the body of the tool in cooperating relationship about the ground rod and driving the ground rod into the ground with a hammer driver whose pin-accepting socket acts downwardly upon the guide pin in a vertical or near-vertical direction while the body of the tool and the ground rod are bound together by torquing forces which are induced through the body by the hammer driver or b) positioning the elongated socket portion about the upper end of the ground rod and driving the ground rod into the ground with a hammer driver whose pin-accepting socket acts downwardly upon the guide pin.

DETAILED DESCRIPTION OF AN ILLUSTRATIVE EMBODIMENT

Figure 1:
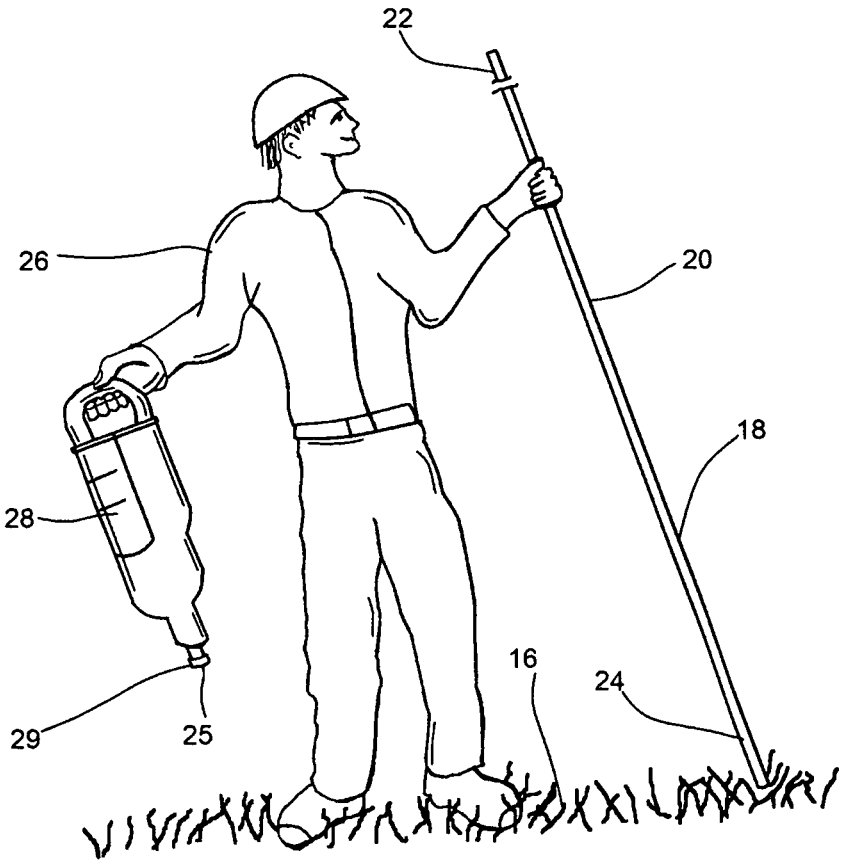
FIG. 1 is a perspective view of an operator holding a ground rod desired to be driven lower end-first into the ground and a commercially-available hammer driver.

Turning now to the drawings in greater detail and considering first FIG. 1, there is illustrated an operator 26, a ground rod 20 desired to be driven lower end-first into the ground 16 and a conventional hammer drill, or driver 28, which can be used with the tool of the present invention for driving the ground rod 20 into the ground 16. Briefly, the ground rod 20 is in the form of an elongated rod of substantially cylindrical shape having upper and lower ends 22 and 24, respectively, and which is constructed of an electrically-conductive material, such as copper. If desired, the cylindrical outer surface, indicated 18, of the ground rod 20 can be galvanized.

Meanwhile, the hammer drill, or driver 28, is an electrically-driven rotary hammer which is commercially available in the market. The driver 28 includes a pin-accepting chuck 29 at the working end thereof and which, during operation of the driver 28, is abruptly forced forwardly and rearwardly (or downwardly and upwardly as viewed in FIG. 1) along an axis of rotation with a hammering action. Consequently, the shank of a drill bit or other elongated pin which is mounted within a pin-accepting socket, indicated 25, of the chuck 29 is forced to move in a hammering action in conjunction with the hammering action of the chuck 29. An example of a commercially-available rotary hammer suitable for use as the rotary driver 28 is a Bosch RH1255VC Rotary Hammer available from Robert Bosch LLC having a corporate office in Farmington Hills, Mich.

Figure 2:
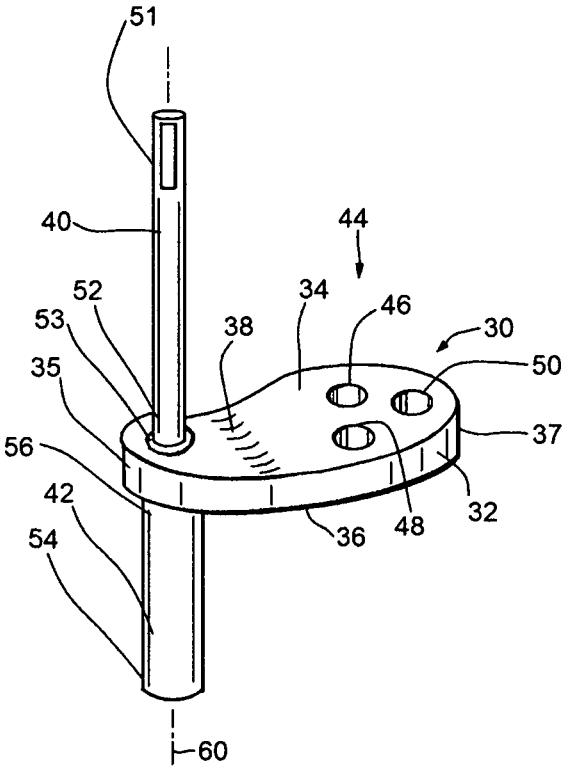
FIG. 2 is a perspective view of a tool embodying features of the present invention.
Figure 4:
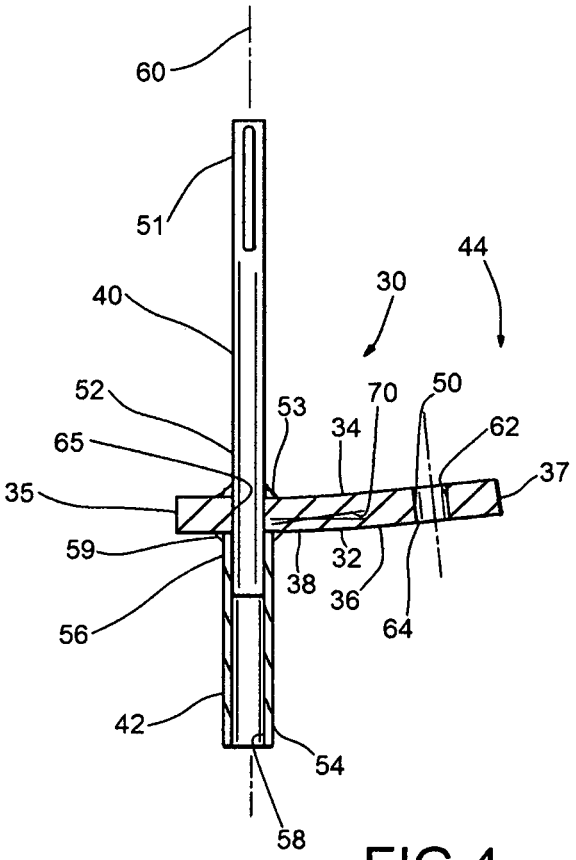
FIG. 4 is a cross-sectional view of the FIG. 2 tool taken about on line 4-4 of FIG. 3.
Figure 3:
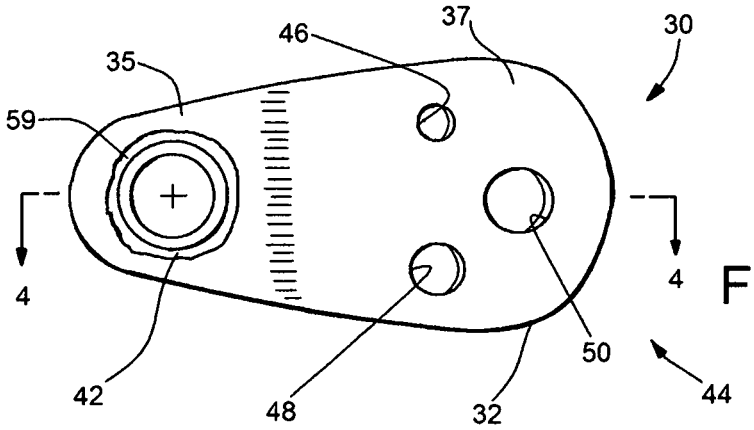
FIG. 3 is a plan view of the tool of FIG. 2 shown generally from below in FIG. 2.

With reference to FIGS. 2-4, there is shown a tool, generally indicated 30, which can be utilized with the hammer driver 28 of FIG. 1 for driving the ground rod 20 lower end-first into the ground 16.

As best shown in FIG. 2, the tool 30 includes a two-sided body 32 having two opposite side faces 34, 36 and a guide pin 40 which is adapted to be accepted by the socket 25 of the chuck 29 of the driver 28 and an elongated socket portion 42 which are joined to the side faces 34 and 36 of the platen-shaped body 32 so as to extend away from the side faces 34, 36 in substantially opposite directions therefrom and along a single, or common, axis 60. The body 32 is elongated in form and somewhat ovoid in shape (as viewed in the plan view of FIG. 3) and has two opposite platen portions 35, 37 adjacent the opposite ends of the body 32. In addition, the body 32 is provided with a relatively small bend 38 which is located between the two opposite end portions 35, 37 so that the fold of the bend 38 extends laterally across the body 32. As will be apparent herein, this bend 38 serves to orient the two end portions 35 and 37 in an angular, or canted, relationship with respect to one another.

It is a feature of the tool 30 that its body 32 has at least one ground rod-accepting passageway, generally indicated 44, extending between the two side faces 34 and 36 and defining with the two opposite side faces 34, 36 a pair of edges, such as those indicated 62 and 64 in FIG. 4, adjacent the side faces 34 and 36. When the tool 30 is used in one manner (as will be described herein) to drive the ground rod 20 into the ground 16, the body 32 is torqued about the ground rod 20 so that the edges 62 and 64 engage and bite into the outer surface 18 of the ground rod 20 to bind the body 32 and the ground rod 20 together and so that as the tool 30 is urged downwardly by the hammer driver 28, the ground rod 20 is urged downwardly, as well.

Within the depicted tool 30, there are provided three parallel rod-accepting passageways 46, 48 and 50 which are each provided by a circular-shaped bore which extends between the side faces 34, 36 and which are each sized to accept a ground rod of a predetermined diameter which is directed endwise therethrough. For example, the passageway 46 has a diameter of about 0.625 inches and is thus sized to closely accept a ground rod having a diameter of 0.5 inches, the passageway 48 has a diameter of about 0.6875 inches and is thus sized to closely accept a ground rod having a diameter of about 0.625 inches, and the passageway 50 has a diameter of about 0.825 inches and is thus sized to closely accept a ground rod having a diameter of about 0.75 inches. It will be understood, however, that since a ground rod can possess a diameter different than 0.5, 0.625 or 0.75 inches, any of the passageways 46, 48 and 50 can possess an alternative diameter from the exemplary diameters suggested herein to closely accept a ground rod possessing a different diameter from those suggested herein.

With reference still to FIGS. 2-4, the guide pin 40 is elongated in shape and has two opposite ends 51, 52. One (or upper) end 51 is provided with a series of axially-extending splines which are regularly spaced about the pin 40 and is adapted to cooperate with (i.e. be operatively accepted by) the pin-accepting socket 25 of the chuck 29 of the hammer driver 28, and the other (or lower) end 52 extends through a bore 65 formed in the platen portion 35 and is joined, as with a weld 53, to the platen portion 35 so that the guide pin 40 extends from the side face 34 of the body 32 and is in a substantially normal relationship with the platen portion 35. Within the depicted tool 30, the guide pin 40 is disposed within a few inches (e.g. about 1.5 inches) from the closest passageway 44, 46 or 48.

The elongated socket portion 42, on the other hand, is in the form of a cylindrical tube having a first end 54 and an opposite second end 56 and defines a hollow interior 58 which opens out of the first end 54 of the socket portion 42. In addition, the socket portion 42 is positioned about the (lower) end 52 of the guide pin 40 and is secured, as with a weld 59, to the platen portion 35 and along the other side face 36 of the body 32 in substantially a normal relationship with the end portion 35 of the body 32 so that the first end 54 of the socket portion 42 extends directly away from the end portion 35.

It is a feature of the tool 30 that the guide pin 40 and the elongated socket portion 42 are axially-aligned with one another along a common longitudinal axis 60 (FIG. 4) and so that the common longitudinal axis 60 of the guide pin 40 and socket portion 42 extends through the platen portion 35 disposed on one side of the bend 38 (FIG. 4). In other words, each of the guide pin 40 and the socket portion 42 are attached (e.g. welded) to the platen portion 35 of the tool body 32 disposed to one side of the bend 38 while the passageways 44, 46 and 48 are formed in the platen portion 37 of the tool body 32 disposed to the side of the bend 38 opposite the platen portion 35. Because of the existence of the bend 38 between the platen portions 35 and 37, the longitudinal axis 60 of the guide pin 40 and the socket portion 42 is not parallel with, and instead is slightly skewed with respect to, the centerline of any of the passageways 44, 46 and 48. Within the depicted tool 30, the planes of the platen portions 35 and 37 form angle 70 (FIG. 4) of between about ten degrees and fourteen degrees—and preferably form an angle 70 of about twelve degrees. This being the case, the longitudinal axis 60 and the centerline of each passageway 44, 46 and 48 are arranged at an angle 72 (FIG. 5) of between about ten and fourteen degrees—and preferably about twelve degrees.

During the use of the tool 20, the aforedescribed angular relationship between the planar portions 35 and 37 (and consequently the angular relationship between the longitudinal axis 60 and the centerline of any passageway 46, 48 or 50) ensures that driver-induced forces which are directed downwardly upon the tool body 32 by way of the guide pin 40 in a substantially vertical or near-vertical direction effects a torquing of the body 32 about the ground rod 20 so that the rod-engaging edges 62 and 64 (FIG. 4), which are vertically-spaced from one on the opposite side of the rod 20, bite into the opposite sides of the outer surface 18 of the ground rod 20 to bind the body 32 of the tool 30 and the ground rod 20 together so that the body 32 is prevented from moving (or sliding) relative to or along the guide rod 20. Therefore and with the tool body 32 and the ground rod 20 bound together in such a manner, the driver-generated forces which are exerted downwardly upon the tool body 32 in a substantially vertical or near-vertical direction effects the downward movement of the lower end 24 of the ground rod 20 into the ground 16.

Stated another way and because of the aforedescribed angular relationship between the guide pin 40 and the center axis of the passageway 46, 48 or 50 through which the ground rod 20 extends, a fraction of the driver-generated forces which are exerted downwardly and substantially axially along the guide pin 40 are used to torque the edges 62, 64 of the passageway 46, 48 or 50 into gripping engagement with the outer surface 18 of the guide rod 20 to prevent movement between the tool body 32 and the ground rod 20 while the remainder of the driver-generated forces which are exerted downwardly upon the body 32 effect the driving of the lower end 24 of the ground rod 20 into the ground 16. It will be understood that during such a ground rod-driving operation, the lower end 24 of the ground rod 20 is in engagement with or anchored to the ground 16 so that any torque-induced movement of the lower end 24 in a sidewise direction across the surface of the ground 16 is resisted by the anchored condition of the lower end 24 of the ground rod 20 with the ground 16.

Each component 32, 40 or 42 is preferably constructed of metal, such as steel.

Figure 5:
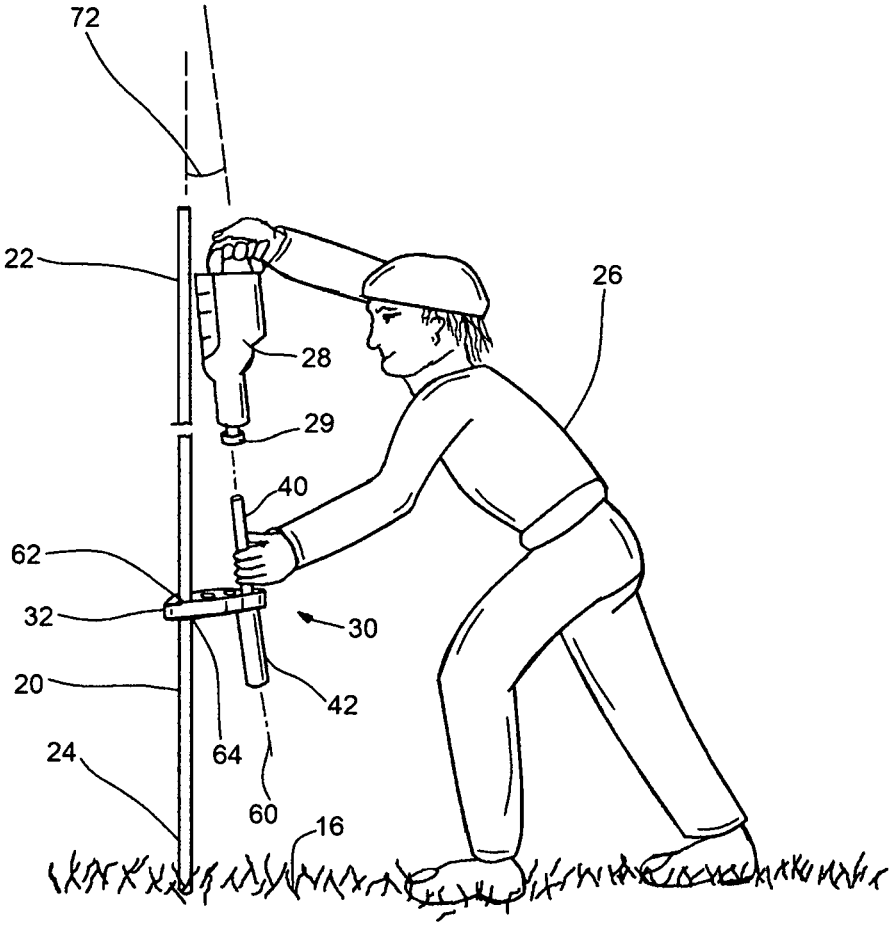
FIG. 5 is a perspective view of the FIG. 2 tool and FIG. 1 hammer driver being readied for driving the ground rod into the ground through an initial phase of movement.

During an initial phase of a rod-driving operation and with reference to FIG. 5, the ground rod 20 is driven into the ground 18 with the tool 30 by positioning one of the passageways 44, 46 or 48 (i.e. the appropriately-sized passageway) of the body 32 about the ground rod 20 and driving the ground rod 16 into the ground 18 with the hammer driver 28 whose pin-accepting socket 25 acts downwardly upon the upper end of the guide pin 40. Because of the aforedescribed angular relationship (i.e. the angle 72 of FIG. 5) which exists between the longitudinal axis 60 of the guide pin 40 and the centerline of the passageway 46, 48 or 50 through which the ground rod 20 extends, the opposing and vertically-spaced edges 62 and 64 of the passageway are torqued into a binding, or gripping, engagement with the outer surface 18 of the guide rod 20 so that the ground rod 20 is forced to move downardly into the ground 16 as the tool body 32 is forced downwardly.

Due, at least in part, to the existence of the elongated socket portion 42 which depends downwardly from the side face 36 of the tool body 32, the upper end 22 of the ground rod 20 cannot be driven to the level of the ground 16 during this initial, or first, phase of a rod-driving operation. In other words and because the ground rod 20 must be gripped by the edges 62, 64 of a rod-accepting passageway of the tool body 32 during the initial phase of a ground rod-driving operation, the upper end 22 of the ground rod 20 cannot be driven any closer to the level of the ground 16 than the length of the socket portion 44. Consequently, the upper end 22 of the ground rod 20 must be driven downwardly to the level of the ground 16 in a second, or final, phase of a ground rod-driving operation.

Figure 6:
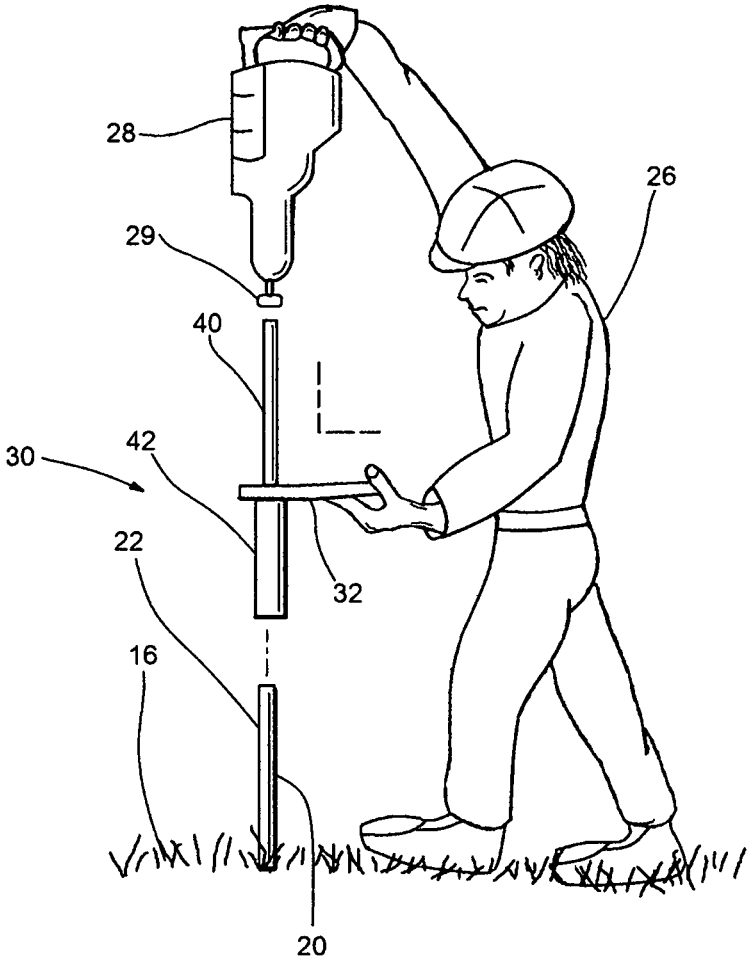
FIG. 6 is a perspective view of the FIG. 2 tool and FIG. 1 hammer tool being readied for driving the ground rod into the ground through a second, or final, phase of movement.

In preparation of the second, or final, phase of a rod-driving operation and with reference to FIG. 6, the tool 30 is removed from its position about the ground rod 20 and then re-positioned upon the ground rod 20. More specifically, the elongated socket portion 42 of the tool 30 is then positioned about (e.g. directed downwardly about) the upper end 22 of the ground rod 20, and the ground rod 20 is driven into the ground 18 with the hammer driver 28 whose pin-accepting socket 25 acts directly downwardly (e.g. axially) upon the upper end 22 of the ground rod 20. Because the hammer driver 28 acts axially downwardly upon the upper end 32 of the ground rod 20 by way of the socket portion 42, the socket portion 42 does not interfere with the movement of the upper end 22 of the ground rod 20 downwardly to the level of the ground 16. That is to say that during this second, or final, phase of the rod-driving operation, the socket portion 42 can be driven downwardly into the ground 16 by the driver 28 along with the ground rod 20.

Therefore and in one, or a first, manner of use and as best shown in FIG. 5, the downward-directed driving power of the hammer driver 28 is exerted downwardly upon the body 32 by way of the guide pin 40 while the edges 34 and 36 of the guide rod-accepting passageway 44, 46 or 48 bite into the outer surface 18 of the ground rod 20 so that the tool body 32 is bound to the ground rod 20 and so that as the body 32 of the tool 30 is urged downwardly by the hammer driver 28, the ground rod 20 is forced downwardly into the ground 16. In contrast, it is during a second, or final, manner of use of the tool 30 during which the ground rod 20 is driven downwardly into the ground 16 during a final, or finishing, phase of movement of the ground rod 20 to its desired position at which the upper end 22 of the ground rod 20 is disposed close to or beneath the level of the ground 16.

Figure 8:
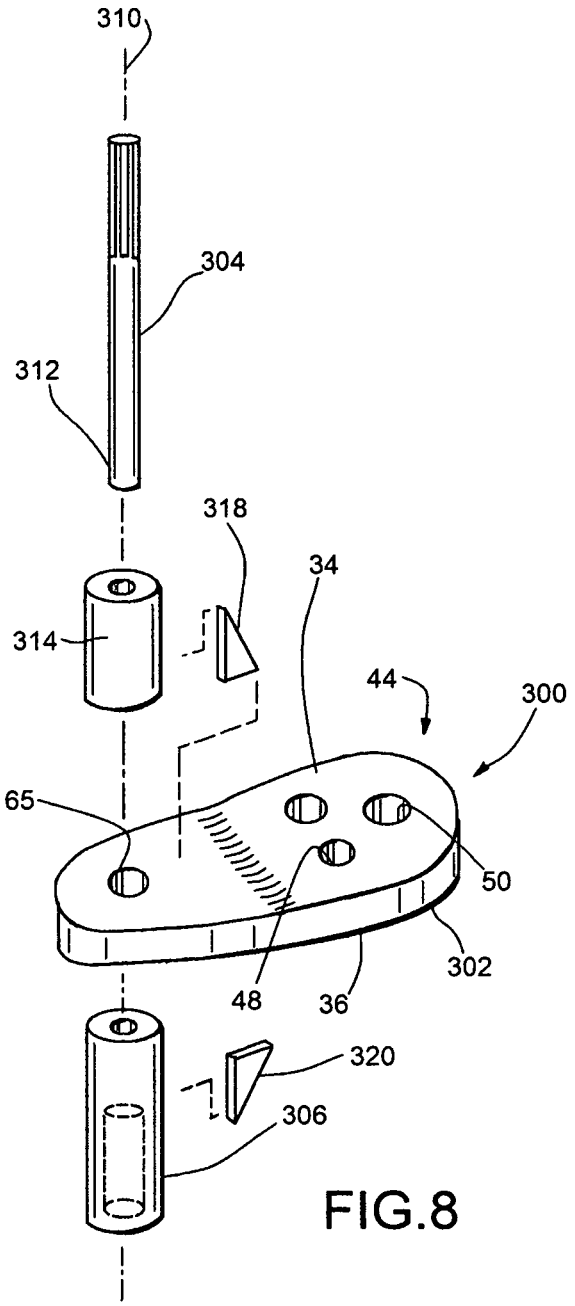
FIG. 8 is a perspective view of the tool of FIG. 7, shown exploded.
Figure 7:
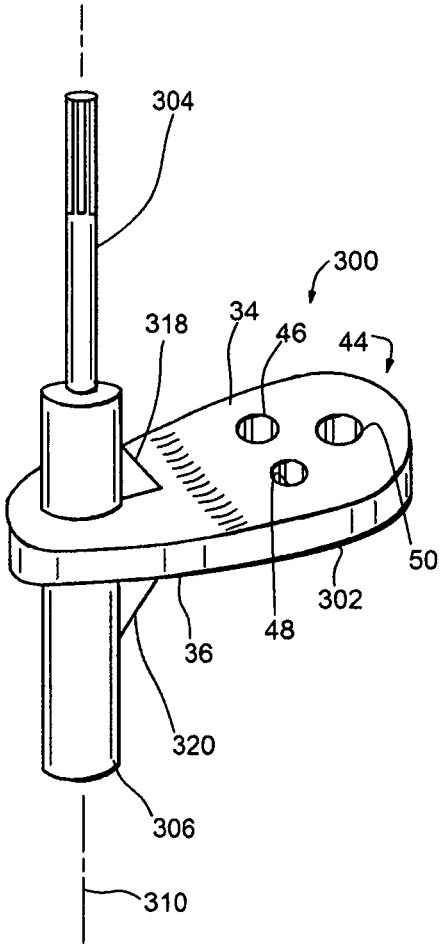
FIG. 7 is a perspective view similar to that of FIG. 2 of an alternative embodiment of a tool within which features of the present invention are embodied.

In an alternative version of the tool of the present invention, the strength of the tool can be enhanced by the inclusion of reinforcing tubing and rib sections which are strategically attached (e.g. welded) at various locations along the tool. For example, there is depicted in FIGS. 7 and 8 an embodiment of a tool, generally indicated 300, comprising a two-sided body 302 (like that of the body 32 of the embodiment 30 of FIGS. 2-6), a guide pin 304 and a socket portion 306 which are joined together along a common axis 310. The guide pin 304 of the depicted tool 300 has a (lower) end portion 312 which is closely accepted by the hollow interior of a relatively short piece 314 of steel tubing. By securing (e.g. welding) the lower end portion 312 of the guide pin 304 within the tubing piece 314 and into the bore 65 formed in the tool body 302 and then welding the tubing piece 314 to the (upper) face 34 of the tool body 302, the guide pin 304 is strengthened along its length by the tubing piece 314.

Meanwhile, the (upper) end of the socket portion 306 is welded to the (lower) face 36 of the platen-shaped body 302 in an axially-aligned relationship with the guide pin 304, and two triangular-shaped rib sections 318, 320 are attached to the various components of the tool 300 for enhancing the capacity of the tool 300 to withstand the relatively high forces applied to the tool 300 by way of the hammer driver 28. More specifically, one rib section 318 is welded between the (upper) face 34 of the tool body 302 and the outer surface of the tubing piece 314, and the other rib section 320 is welded between the (lower) face 36 of the tool body 302 and the outer surface of the socket portion 306.

Exemplary dimensions of the tool 300 are provided here as follows: the length of the guide pin 304 as measured from the face 34 of the platen-shaped body 302 is about 6.75 inches; the length of the guide pin 304 is about 0.6875 inches; the thickness of the platen-shaped body 302 is about 0.5 inches; the (maximum) length of the platen-shaped cody 302 is about 5.4 inches; the (maximum) width of the platen-shaped body 302 is about 2.75 inches; the length of the socket portion 306 is about 4.25 inches; the outer diameter of the socket portion 306 is about 1.25 inches; and the diameter of the hollow interior of the socket portion 306 is about 0.75 inches.

Figure 9:
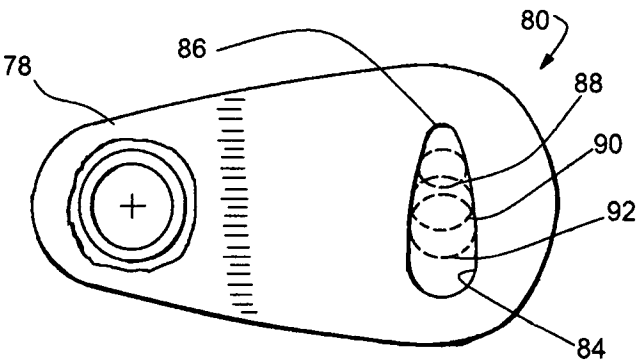
FIG. 9 is a plan view similar to that of FIG. 3 of another embodiment of a tool within which features of the present invention are embodied.

It will be understood that numerous modifications and substitutions can be had to the aforedescribed embodiments 30 or 300 without departing from the spirit of the invention. For example, although the ground rod-accepting passageway 44 of the aforedescribed embodiments 30 and 300 has been shown and described as being in the form of a circular opening 46, 48 or 50, the ground rod-accepting passageway could take another form. For example, there is depicted in FIG. 9, an alternative tool, generally indicated 80, having a body 78 defining a passageway 82 which is in the form of an ovoid, or egg-shaped, opening 84 whose opposing edges converge toward one another as a path is traced from the largest portion of the passageway 82 toward one, or the smallest, end, indicated 86 in FIG. 9 of the opening 84 so that by positioning the opening 84 about a ground rod and then urging the ground rod toward the end 86 of the opening 84, the opposing edges of the opening 84 are in condition to bite into the outer surface of the ground rod when the tool 80 is driven downwardly with a hammer driver 28 (and torqued about the ground rod) by way of the guide pin of the tool 80. Examples of ground rods (having different-sized diameters) capable of being driven in the ground with the FIG. 9 tool 80 include ground rods 88, 90 and 92 depicted in phantom in FIG. 9.

Figure 10:
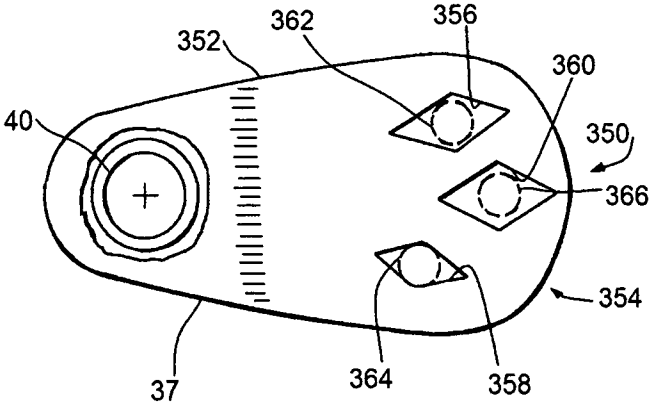
FIG. 10 is a plan view similar to that of FIG. 3 of still another embodiment of a tool within which features of the present invention are embodied.

Similarly, there is depicted in FIG. 10 still another embodiment, generally indicated 350, of a tool having a body 352 including a passageway-defining means 354 including three diamond-shaped 356, 358, 360 which are disposed across the platen portion 37 of the tool body 352 wherein each opening 356, 358 or 360 is adapted to closely accept a ground rod directed endwise therein. As is the case with the tool 30 of FIGS. 2-6, when the tool 350 is positioned about a ground rod so that the ground rod extends through the passageway opening 356, 358 or 360 and then a hammer driver 28 is used to drive the tool 350 downwardly by way of the guide pin 40 of the tool 350, the opposing edges of the opening 356, 358 or 360 are torqued into binding engagement with the outer surface of the ground rod so that the ground rod, and in particular, the lower end of the ground rod, is urged downwardly into the ground 16. Examples of ground rods (having different-sized diameters) capable of being driven in the ground with the FIG. 10 tool 350 include ground rods 362, 364 and 366 depicted in phantom in FIG. 10.

Figure 11:
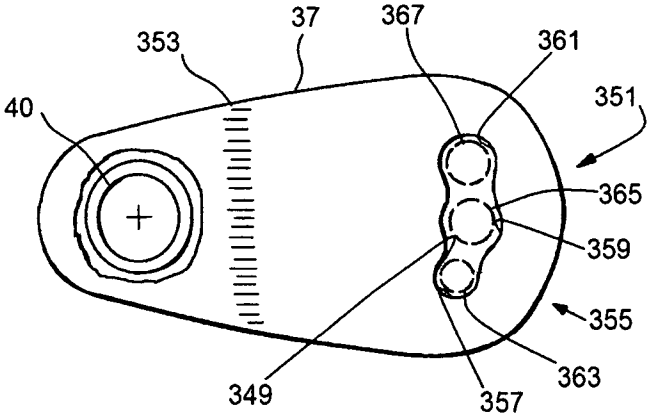
FIG. 11 is a plan view, similar to that of FIG. 3 of still another embodiment of a tool within which features of the present invention are embodied.

Similar still, there is depicted in FIG. 11 still another embodiment, generally indicated 351, of a tool having a body 353 including a passageway-defining means 355 in the form of an elongated passageway 349 having a cross section defining three enlarged regions 357, 359, 361 which are disposed across the platen portion 37 of the tool body 353 wherein each enlarged region 357, 359 or 361 is adapted to closely accept a ground rod directed endwise therein. As is the case with the tool 30 of FIGS. 2-6, when the tool 351 is positioned about a ground rod so that the ground rod extends through one of the enlarged regions 357, 359 or 361 of the passageway 349 and then a hammer driver 28 is used to drive the tool 351 downwardly by way of the guide pin of the tool 351, the opposing edges of the opening 357, 359 or 361 are torqued into binding engagement with the outer surface of the ground rod so that the ground rod, and in particular, the lower end of the ground rod, is urged downwardly into the ground 16. Examples of ground rods (having different-sized diameters) capable of being driven in the ground with the FIG. 11 tool 351 include ground rods 363, 365 and 367 depicted in phantom in FIG. 11.

Figure 12:
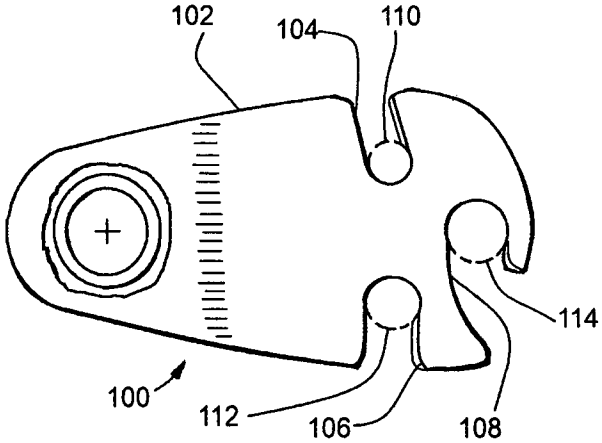
FIG. 12 is a plan view similar to that of FIG. 3 of a further embodiment of a tool within which features of the present invention are embodied.

Furthermore, there is depicted in FIG. 12 still another embodiment, generally indicated 100, of a tool having a two-sided body 102 having a plurality of (i.e. three differently-sized passageways 104, 106 or 108 which are each provided by a notch which opens out of the sides or end of the body 102 and which has a base, or bottom, which is sized to nestingly accept a ground rod (such as ground rods 110, 112 or 114 depicted in phantom in FIG. 12) directed sideways into the correspondingly-sized passageway 104, 106 or 108. Once positioned within the correspondingly-sized passageway 104, 106 or 108, the edges of the passageway 104, 106 or 108 are in condition to be torqued into binding engagement with the outer surface of the ground rod when the hammer driver 28 is used to drive the tool 100 downwardly by way of the guide pin of the tool 100. The tool 100 of FIG. 12 may be preferred over the tool 30 or 80 of FIGS. 2-11 in an instance in which it would be preferable to direct the ground rod sideways into the rod-accepting passageway of the tool, rather than direct the ground rod endwise into the rod-accepting passageway of the tool.

Further still and due to the possible wear, over time, upon the edges of a ground rod-accepting passageway 50 as the passageway edges act against the exterior surfaces of the ground rod 20 during a rod-driving operation, it may be desirable to render the edges of the ground rod-accepting passageway 50 replaceable. In this connection and with reference to FIG. 13, there is shown a ground rod driving tool 120 having an internally-threaded opening 122 within which a replaceable ring member 124 can be inserted. The ring member 124 defines a rod-accepting passageway 126 adapted to closely accept a ground rod inserted endwise therein and also defines external threads 128 which enable the ring member 124 to be threadably received by the opening 122.

Figure 14:
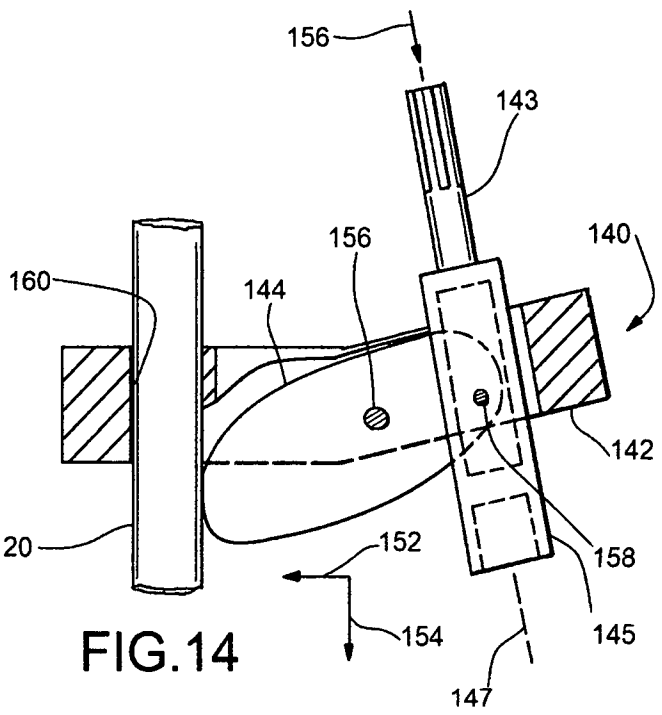
FIG. 14 is a longitudinal cross-sectional view of one more embodiment of a tool within which features of the invention are embodied and shown positioned in cooperating relationship with a ground rod for purposes of driving the ground rod into the ground.

Yet further still, there is depicted in FIG. 14 a ground rod driving tool 140 having a body 142 and a guide pin 143 and a socket portion 145 which are integrally joined together along a common axis 147. Furthermore, there is provided a cam member 144 which is pivotally attached to the tool body 142 by way of a pin 156 and is pivotally connected to the socket portion 145 by way of a pin 158 disposed through the tool body 142 on the side thereof opposite the guide rod 22. During a ground rod-driving operation performed with the tool 140, a driving force 156 is directed axially along the guide pin 148, and the force 156 includes torquing forces which act against the ground rod 150 by way of the cam member 144 to bind the tool body 142 to the ground rod 20 and downwardly-directed forces which urge the ground rod 20 downwardly into the ground. In this regard, the substantially downwardly-directed force which is exerted upon the drive rod 20 by way of the cam member 144 is believed to include a laterally-directed force vector 152 which is exerted laterally against a side of the drive rod 20 to help squeeze the ground rod 20 within the ground rod-accepting passageway, indicated 160 in FIG. 14, and a downwardly-directed force vector 154 which urges the tool 140 and ground rod 20 downwardly into the ground 16.

Figure 15:
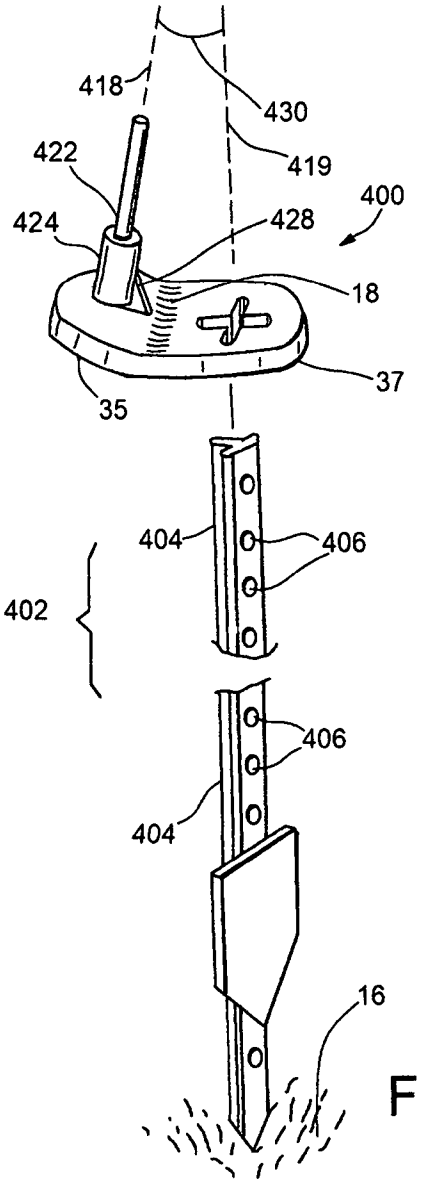
FIG. 15 is a perspective view of still one more embodiment of a tool within which features of the present invention and a fence post capable of being driven into the ground with a tool.
Figure 16:
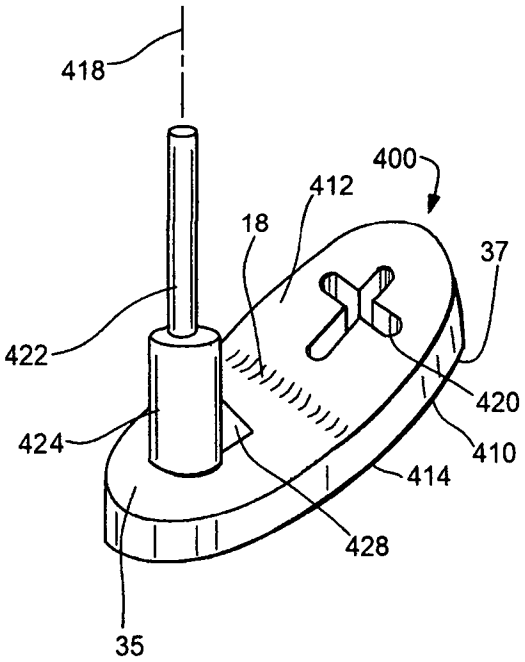
FIG. 16 is a perspective view of the FIG. 15 tool, shown from an alternative angle to the angle shown in FIG. 15.
Figure 17:
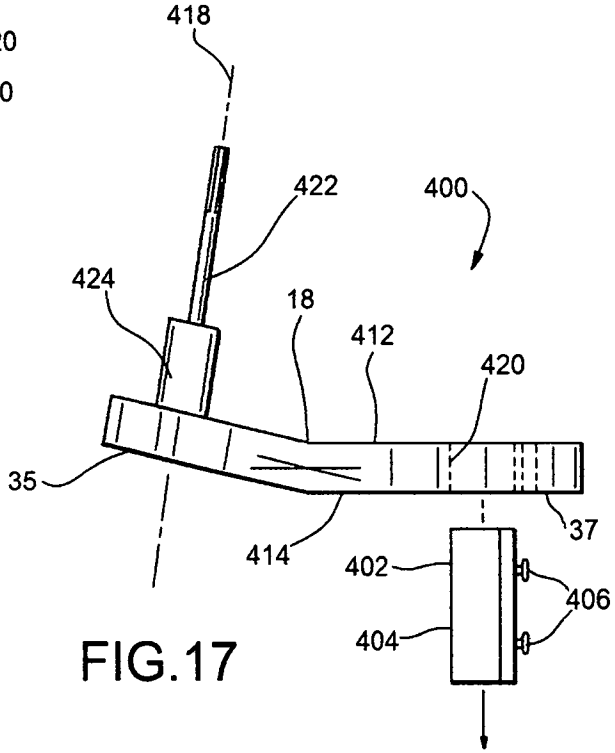
FIG. 17 is a plan view of the FIG. 15 tool and a fragment of the FIG. 15 post as seen generally from the right in FIG. 15.

With reference to FIGS. 15-17, there is shown one more embodiment, generally indicated 400, of a tool of the present invention and a post 402 (e.g. a fence post or sign post) which is capable of being driven downwardly into the ground 16 with the tool 400 and the commercially-available hammer driver 28 of FIG. 1. In this connection, the post 402 is of a class commonly constructed of metal, such as steel, and possesses an elongated body 404 whose cross section is substantially T-shaped. The post 402 also includes a plurality of tabs 406 which are regularly spaced along the length of the body 404 thereof.

The tool 400 includes a two-sided body 410 having upper and lower faces 412 and 414, respectively, and a post-accepting passageway 420 which extends between the faces 412 and 414. The passageway 420 is substantially T-shaped in cross section (as viewed in plan view) to closely accept the elongated body 404 of the post 402 when the passageway 420 is directed thereover. Accordingly, the passageway 420 is shaped to substantially conform to the cross-sectional shape of the body 404 of the post 406 (while accounting for the existence of the tabs 406) so that by directing the passageway 420 of the body 410 downwardly over the upper end of the post 402, the post 402 is closely accepted by the passageway 420.

The tool 400 also includes a guide pin 422 which is securely attached to the upper face 412 of the body 410 so that the upper end of the guide pin 422 can be accepted by the chuck 29 (FIG. 1) of the driver 28 when the chuck 29 is directed downwardly thereover. The guide pin 422 is in the form of an elongated pin, and a short piece 424 of steel tubing is positioned about and secured to the lower end of the pin 422 with welds. The tubing piece 424 is, in turn, secured to the face 412 of the tool body 410 with welds. A triangular-shaped rib section 428 is positioned alongside the tubing piece 424 and welded to both the tubing piece 424 and the face 412 of the body 410 to help strengthen the guide pin 422 and help rigidify the joined pin-to-body 410 arrangement.

Figure 13:
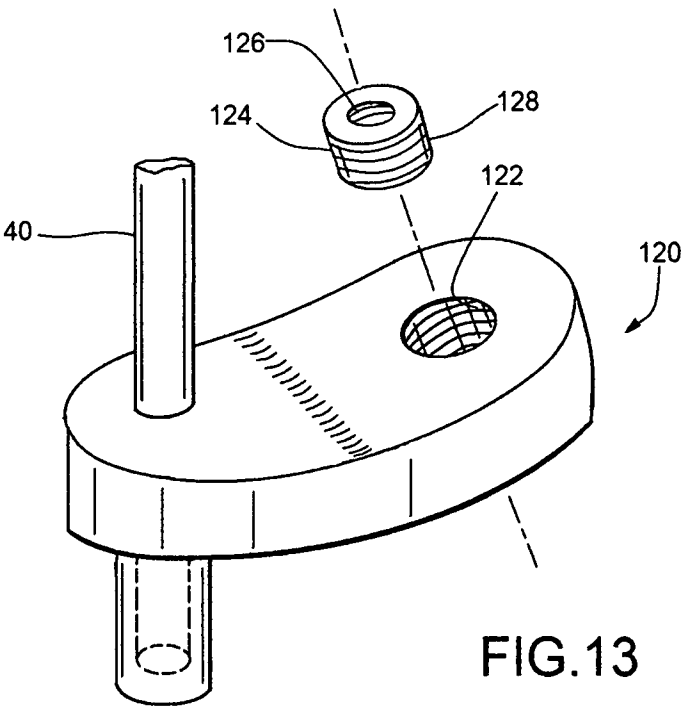
FIG. 13 is a perspective view of a still further embodiment of a tool within which features of the invention are embodied.

As is the case with the two-sided body 32 of the tool 30 of FIGS. 2-6, the body 410 of the tool 400 of FIGS. 13-15 has a platen portion 35 adjacent one end of the body 410 and a platen portion 37 positioned adjacent the other end of the body 410, and the platen portions 35 and 37 are separated by a bend 18 so that the planes within which the platen portions 35 and 37 lie are oriented in an angular orientation with respect to one another thus ensuring that the guide pin axis, indicated 418 in FIG. 15, is disposed at an angular relationship with respect to the centerline, indicated 419, of the post-accepting passageway 420. This being the case, the guide pin axis 418 along which the driving forces which are generated by the hammer driver 28 act upon the guide pin 422 are angularly offset from the downward direction along which post-driving forces are transferred to the post 402 by way of the passageway 420 and, more particularly, by way of the post-engaging edges of the passageway 420. As is the case with the guide pin and passageway centerline of the tool 30 of FIGS. 2-6, the guide pin 422 and the centerline of the post-accepting passageway 420 are disposed at an angle 430 (FIG. 15) of between about ten degrees and fourteen degrees, and preferably about twelve degrees.

To use the tool 400 to drive the lower end of the post 402 downwardly into the ground 16, the post 402 is held upright and in a substantially vertical orientation so the lower end of the post 402 engages the ground 16 at a location thereon at which the post 402 is desired to be driven, and the post-accepting passageway 420 of the tool body 410 is directed downwardly over the post 402 to a convenient working height (e.g. to about a waist-high level). The chuck 29 of the driver 28 is then directed downwardly over the guide pin 422. With one hand of an operator holding the post 402 upright and the other hand of the operator holding the driver 28 in operative, or working, relationship with the guide pin 422, the driver 28 is switched ON so that the post 402 is driven downwardly into the ground 16 by way of the tool 400.

In accordance with the operating principles of the tool embodiments of the present invention (described above in connection with a first, or initial, phase of a ground rod-driving operation) and as the driver 18 is used to drive the tool body 410 downwardly by way of the guide pin 422, the body 410 is torqued about the post 402 so that the post-engaging edges of the passageway 420 are urged into a binding relationship with the outer surface of the post 402 and the post 402 is driven downwardly into the ground 16 as the tool 400 is driven downwardly. The post driving operation is completed when the lower end of the post 402 has been driven downwardly into the ground 16 to a desired depth. At that point, the driver 28 is simply lifted from the guide pin 420, and then the tool 400 is lifted, and thus removed, from its position about the post 402.

Accordingly, the aforedescribed embodiments are intended for the purpose of illustration and not as limitation.

The invention claimed is:

1. A tool for use with a hammer driver having a pin-accepting socket for driving an item into the ground wherein the item has a lower end which is desired to be driven into the ground, the tool comprising:

a body which is positionable in cooperating relationship with the item to be driven into the ground so that forces which are exerted downwardly upon the body in a substantially vertical or near-vertical direction prevents the movement of the body relative to the item;

a guide pin which is joined to so as to extend from the body and which is adapted to be received by the pin-accepting socket of the hammer driver so that by positioning the body in said cooperating relationship with the item at a location therealong which is above the lower end thereof, positioning the pin-accepting socket of the hammer driver about the guide pin and then driving the body downwardly through the guide pin in a substantially vertical or near-vertical direction with the hammer driver, the lower end of the item is driven into the ground;

wherein the body of the tool defines a passageway which is sized to accept a portion of the item when the body is positioned in said cooperating relationship with the item; and wherein the passageway defines item-engaging edges which engage the portion of the item accepted by the passageway when the body of the tool is positioned in said cooperating relationship with the item and so that when forces are exerted downwardly upon the guide pin by the hammer driver and the lower end of the item is positioned in engagement with the ground, the edges of the passageway are torqued in a manner which binds the body of the tool to the portion of the item and transfers the driving forces which are exerted downwardly upon the guide pin by the hammer driver to the item; and wherein the item-engaging edges of the passageway include two edges which apply torquing forces to the portion of the item accepted by the passageway, and so that when the portion of the item is accepted by the passageway as aforesaid, the two edges are vertically spaced from one another and are disposed on opposite sides of the portion of the item.

2. The tool as defined in claim 1 wherein the guide pin is elongated in shape and has a longitudinal axis, and the guide pin is adapted to accept driving forces from the hammer driver along the longitudinal axis of the guide pin, and the guide pin is oriented in such a relationship to the body so that when the body is positioned in said cooperating relationship with the item to be driven into the ground, the longitudinal axis along which the driving forces are applied from the hammer driver is angularly offset from the downward direction along which the item is desired to be driven.

3. The tool as defined in claim 2 wherein said angular offset between the longitudinal axis of the guide pin and the downward direction along which the item is desired to be driven is within the range of between about ten degrees and fourteen degrees.

4. The tool as defined in claim 3 wherein said angular offset is about twelve degrees.

5. The tool as defined in claim 1 wherein the body of the tool includes two substantially platen portions which are joined together at a bend, and the guide pin is joined to one of the two substantially platen portions and the passageway is formed in the other of the two substantially platen portions.

6. The tool as defined in claim 5 wherein the guide pin is elongated in shape and has a longitudinal axis, and the guide pin is adapted to accept driving forces from the hammer driver along the longitudinal axis of the guide pin, and the guide pin is secured to the one of the two substantially platen portions in a substantially normal relationship therewith, and the one and the other of the two substantially platen portions are oriented in planes which are angularly offset from one another.

7. The tool as defined in claim 6 wherein the one and the other of the two substantially platen portions are angularly offset from one another by an amount which falls within the range of between about ten and fourteen degrees.

8. The tool as defined in claim 6 wherein the one and the other of the two substantially platen portions are angularly offset from one another by about twelve degrees.

9. A tool for use with a hammer driver having a pin-accepting socket for driving an elongated item into the ground wherein the item has a lower end which is desired to be driven into the ground, the tool comprising:

a body;

a guide pin which is joined to so as to extend from the body and is adapted to be received by the pin-accepting socket of the hammer driver; and the body is positionable in cooperating relationship with the item desired to be driven into the ground so that by positioning the body in the cooperating relationship with the item at a location therealong which is above the lower end thereof, positioning the pin-accepting socket of the hammer driver about the guide pin and then driving the body downwardly through the guide pin in a substantially vertical or near-vertical direction with the hammer driver while the lower end of the elongated item is positioned in engagement with the ground, the body of the tool and the item are bound together by torquing forces which are induced through the body by the hammer driver;

wherein the body of the tool defines a passageway which is sized to accept a portion of the item when the body is positioned in said cooperating relationship with the item; and wherein the passageway defines item-engaging edges which engage the portion of the item accepted by the passageway when the body of the tool is positioned in said cooperating relationship with the item and so that when forces are exerted downwardly through the guide pin by the hammer driver and the lower end of the item is positioned in engagement with the ground, the edges of the passageway are torqued about a substantially horizontal axis in a manner which binds the body of the tool to the portion of the item and transfers the forces which are exerted downwardly upon the guide pin by the hammer driver to the item; and wherein the item-engaging edges of the passageway include two edges which apply torquing forces to the portion of the item accepted by the passageway, and so that when the portion of the item is accepted by the passageway as aforesaid, the two edges are vertically spaced from one another and are disposed on opposite sides of the portion of the item.

10. The tool as defined in claim 9 wherein the guide pin is elongated in shape and has a longitudinal axis, and the guide pin is adapted to accept driving forces from the hammer driver along the longitudinal axis of the guide pin, and the guide pin is oriented in such a relationship to the body so that when the body is positioned in cooperating relationship with the item to be driven into the ground, the longitudinal axis along which the driving forces are applied from the hammer driver is angularly offset from the downward direction along which the item is desired to be driven.

11. The tool as defined in claim 10 wherein said angular offset between the longitudinal axis of the guide pin and the downward direction along which the item is desired to be driven is within the range of between about ten degrees and fourteen degrees.

12. The tool as defined in claim 9 wherein the body of the tool includes two substantially platen portions which are joined together at a bend, and the guide pin is joined to one of the two substantially platen portions and the passageway is formed in the other of the two substantially platen portions.

13. The tool as defined in claim 12 wherein the guide pin is elongated in shape and has a longitudinal axis, and the guide pin is adapted to accept driving forces from the hammer driver along the longitudinal axis of the guide pin, and the guide pin is secured to the one of the two substantially platen portions in a substantially normal relationship therewith, and the one and the other of the two substantially platen portions are oriented in planes which are angularly offset from one another.

14. The tool as defined in claim 13 wherein the one and the other of the two substantially platen portions are angularly offset from one another by an amount which falls within the range of between about ten and fourteen degrees.

15. A tool for use with a hammer driver having a pin-accepting socket for driving an item into the ground wherein the item has a lower end which is intended to lead the item into the ground as the item is driven therein, the tool comprising:

a body;

a guide pin which is joined to so as to extend from one of the side faces of the body; and the body is positionable in cooperating relationship with the item desired to be driven into the ground so that by positioning the body in the cooperating relationship with the item at a location therealong which is above the lower end thereof, positioning the pin-accepting socket of the hammer driver about the guide pin and then driving the body downwardly through the guide pin in a substantially vertical or near-vertical direction with the hammer driver while the lower end of the elongated item is positioned in engagement with the ground, the body of the tool and the item are bound together by torquing forces which are induced through the body by the hammer driver;

wherein the body of the tool defines an item-accepting passageway, and the item-accepting passageway of the body is sized to be positioned about the item to be driven into the ground when the body is positioned in said cooperating relationship with the item so that the item can be driven into the ground with the tool by positioning the passageway of the body about the item and driving the item into the ground with a hammer driver whose pin-accepting socket acts downwardly upon the guide pin; and wherein the passageway defines item-engaging edges which engage the portion of the item accepted by the passageway when the body of the tool is positioned in said cooperating relationship with the item and so that when forces are exerted downwardly through the guide pin by the hammer driver and the lower end of the item is positioned in engagement with the ground, the edges of the passageway are torqued in a manner which binds the body of the tool to the portion of the item and transfers the forces which are exerted downwardly upon the guide pin by the hammer driver to the item; and wherein the item-engaging edges of the passageway include two edges which apply torquing forces to the portion of the item accepted by the passageway, and so that when the portion of the item is accepted by the passageway as aforesaid, the two edges are vertically spaced from one another and are disposed on opposite sides of the portion of the item.

16. The tool as defined in claim 15 wherein the item to be driven into the ground has a cross-sectional shape, and the item-accepting passageway of the body has a cross sectional shape which is adapted to accept the item when the passageway is directed thereover.

* * * * *